US005180198A

United States Patent [19]

Nakamura et al.

[11] Patent Number: 5,180,198

[45] Date of Patent: Jan. 19, 1993

[54] MOTOR DRIVEN LOCK DEVICE FOR TRUNK LID AND THE LIKE

[75] Inventors: Shuji Nakamura; Mitsuru Tamiya, both of Nirasaki, Japan

[73] Assignee: Mitsui Kinzoku Kogyo Kabushiki Kaisha, Tokyo, Japan

[21] Appl. No.: 834,084

[22] Filed: Feb. 12, 1992

[30] Foreign Application Priority Data

Feb. 16, 1991 [JP] Japan ..... 3-44487

[51] Int. Cl.[5] ..... E05B 53/00; E05C 3/26

[52] U.S. Cl. ..... 292/201; 70/264; 292/DIG. 43

[58] Field of Search ..... 292/DIG. 43, 207, 210; 70/264

[56] References Cited

U.S. PATENT DOCUMENTS

| | | | |
|---|---|---|---|
| 4,342,209 | 8/1982 | Kleefeldt | 70/264 |
| 4,892,339 | 1/1990 | Kleefeldt et al. | 292/201 |
| 4,892,340 | 1/1990 | Matumoto | 292/201 |
| 4,906,035 | 3/1990 | Nagai et al. | 292/DIG. 43 |
| 4,962,955 | 10/1990 | Ferrara et al. | 292/DIG. 43 |
| 4,976,477 | 12/1990 | Nakao | 292/DIG. 43 |
| 4,986,579 | 1/1991 | Ishikawa | 292/201 |
| 4,998,758 | 3/1991 | Kowalczyk et al. | 292/DIG. 43 |
| 5,040,390 | 8/1991 | Mistry et al. | 292/DIG. 43 |
| 5,046,341 | 9/1991 | Ogino et al. | 70/264 |

*Primary Examiner*—Eric K. Nicholson
*Attorney, Agent, or Firm*—Browdy and Neimark

[57] ABSTRACT

An electric driven type lock device used to a car trunk lid has a striker, a latch, and a ratchet for preventing the latch from reverse-rotating. When the striker reaches its position confronting a U-shaped groove or notch formed in the latch, a motor makes the pressing link rotate forcibly in a closed-lid direction. An electric-driven-condition relief link is connected to the ratchet. When the motor reversely rotates, the electric-driven-condition relief link makes the ratchet leave from the latch. Further, the lock device has a manual relief lever which to lever the pressing link and the ratchet are connected. When the manual relief lever is operated, the pressing link is left from a rotation track of the latch, as well as the ratchet is left from the latch.

5 Claims, 5 Drawing Sheets

MOTOR DRIVEN LOCK DEVICE FOR TRUNK LID AND THE LIKE

FIELD OF THE INVENTION

The present invention relates to a motor driven lock device used for a car trunk lid and the like.

DESCRIPTION OF THE PRIOR ART

Conventional motor driven lock devices comprise a striker fixed to a trunk lid of car and a latch rotatably attached to the car body structure, the latch being adapted to reversely rotate by means of an electric motor. According to the known conventional lock device, an operator lightly shuts the trunk lid by hand, the striker reaches a position at which the striker comes in contact with a U-groove or notch of the latch, then a switch for the motor turns on making the latch forcibly turn or rotate along a shutting or close-lid direction thereby closing the trunk lid completely. The operator or driver can operate another switch installed at a driver's seat for the motor. Operating the motor switch, the motor reversely rotates so as to turn the latch in its open-lid direction releasing an engagement of the latch with the striker and opening the trunk lid.

In addition, the conventional lock device of the trunk lid has a manual release mechanism adapted to open the trunk lid if the electric system for the motor does not operate.

In the conventional lock device is made useless when the latch rotates by the motor and the electric system fails to properly operate. The reason for this problem is a link connecting the motor and the latch which engages with other members or parts when in lock condition which immobilizes the latch when the motor fails.

SUMMARY OF THE INVENTION

The purpose of the present invention is to provide a motor driven lock device for a car trunk lid and the like, which lock device solves the shortcomings of conventional motor driven lock devices.

Another purpose of the present invention is to provide the motor driven lock device for a car trunk lid and the like which has a universal construction enabling the setting of the timing of engagement and release of various parts of the lock device.

DESCRIPTION OF THE PREFFERRED EMBODIMENTS

Figure 1:
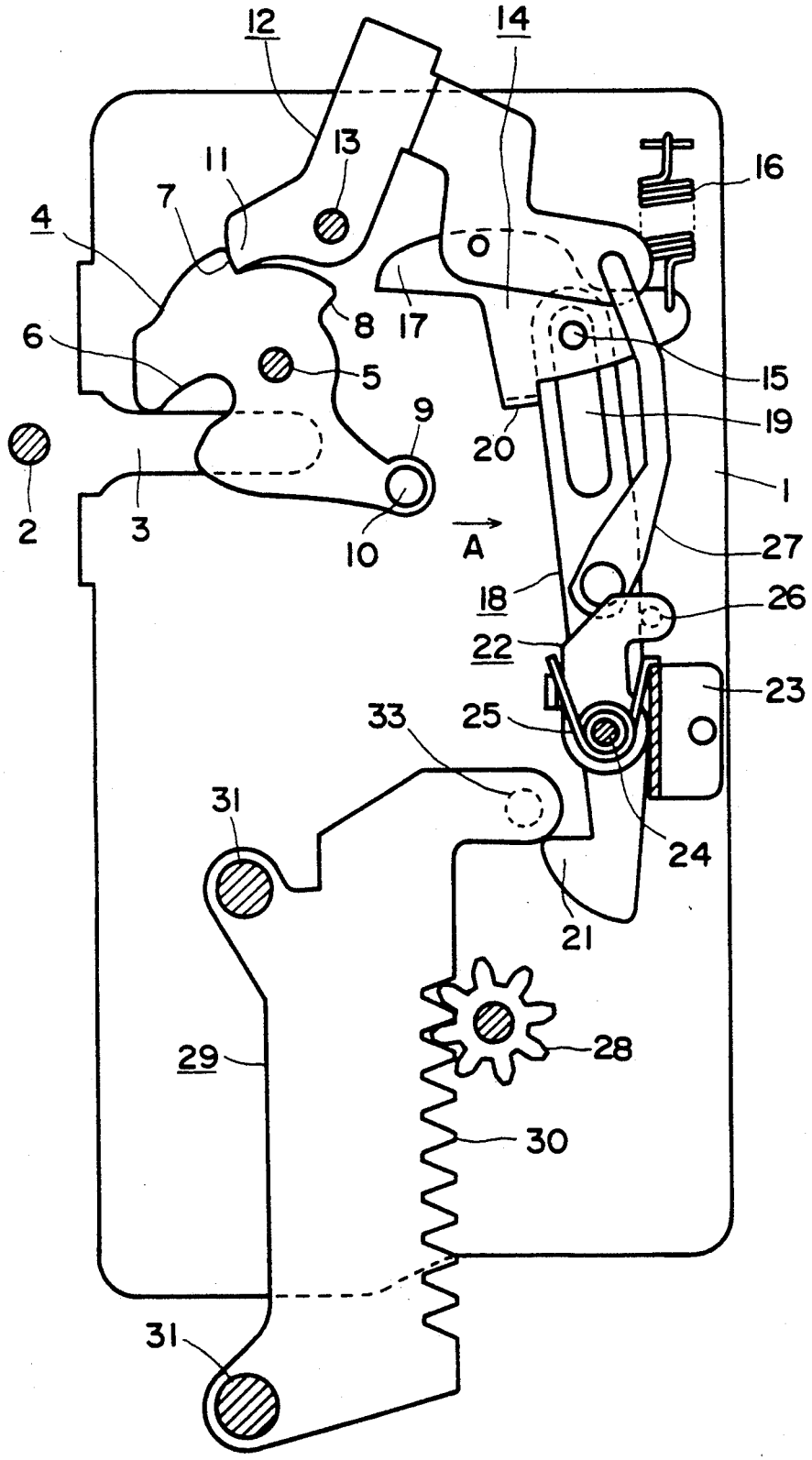
FIG. 1 is a partial elevation view of the motor driven lock device in its door open condition according to the present invention.

One embodiment of the motor driven lock device used to a trunk lid of the car will be explained with reference to the accompanying drawings.

A base plate 1 of the motor driven lock device according to the present invention is secured to the vehicular body, and has a guide groove 3, through which a striker 2 enters, which is secured to a trunk lid (not shown). A latch 4 is rotatably journalled with a shaft 5 secured to a position neighboring to the guide groove 3. Around the latch 4, there are a U-shaped groove 6 adapted to engage with the striker 2, an open-lid position engagement stepped portion 7, and a close-lid position engagement stepped portion 8. The latch 4 has an radial extension portion provided with an end 9, to which end engagement protrusion 10 projecting forwardly is secured. The latch 4 is urged to turn clockwise by a spring (not shown). A ratchet 12, provided with a claw portion 11 adapted to selectively engage with the open-lid position engagement stepped portion 7 or the close-lid position engagement stepped portion 8, is journalled with a position near the latch 4 by a shaft 13. The ratchet 12 is forcibly turned counterclockwise by a spring (not shown).

A pressing lever 14 is rotatably journalled by a shaft 15 at a position side of the latch 4. The pressing lever 14 is urged constantly counterclockwise by a coil spring 16. The pressing lever 14 has a leg portion 17, which is adapted to engage with the end 9 of the latch 4 when the latch 4 rotates as shown in FIG. 3 to a close-lid position.

An electric-driven-condition relief link 18 has a long vertical length, and a long opening 19 in an upper portion of the link 18. It is noted that the shaft 15 loosely fits into the long opening 19. The pressing lever 14 has an engagement portion 20 adapted to come into contact with the electric-driven-condition relief link 18. When the engagement portion 20 contacts with link 18, the link 18 is pressed toward an arrow direction A. A key portion 21 is formed at a lower end of the electric-driven-condition relief link 18.

It is explicit that a rotary lever 22 secured to a cover plate 23 through a shaft 24 is urged counterclockwise by a spring 25. The rotary lever 22 has a projection 26 adapted to engage with the link 18, when the link 18 is pressed along a counterclockwise direction A. When the end 9 of the latch 4 doesn't engage with the leg portion 17 of the pressing lever 14 (open-lid condition), a resilient force of the coil spring 16 overcomes that of the spring 25, and the electric-driven-condition relief link 18 moves in the arrow A direction and stops at its condition contacting with the cover plate 23.

Figure 3:
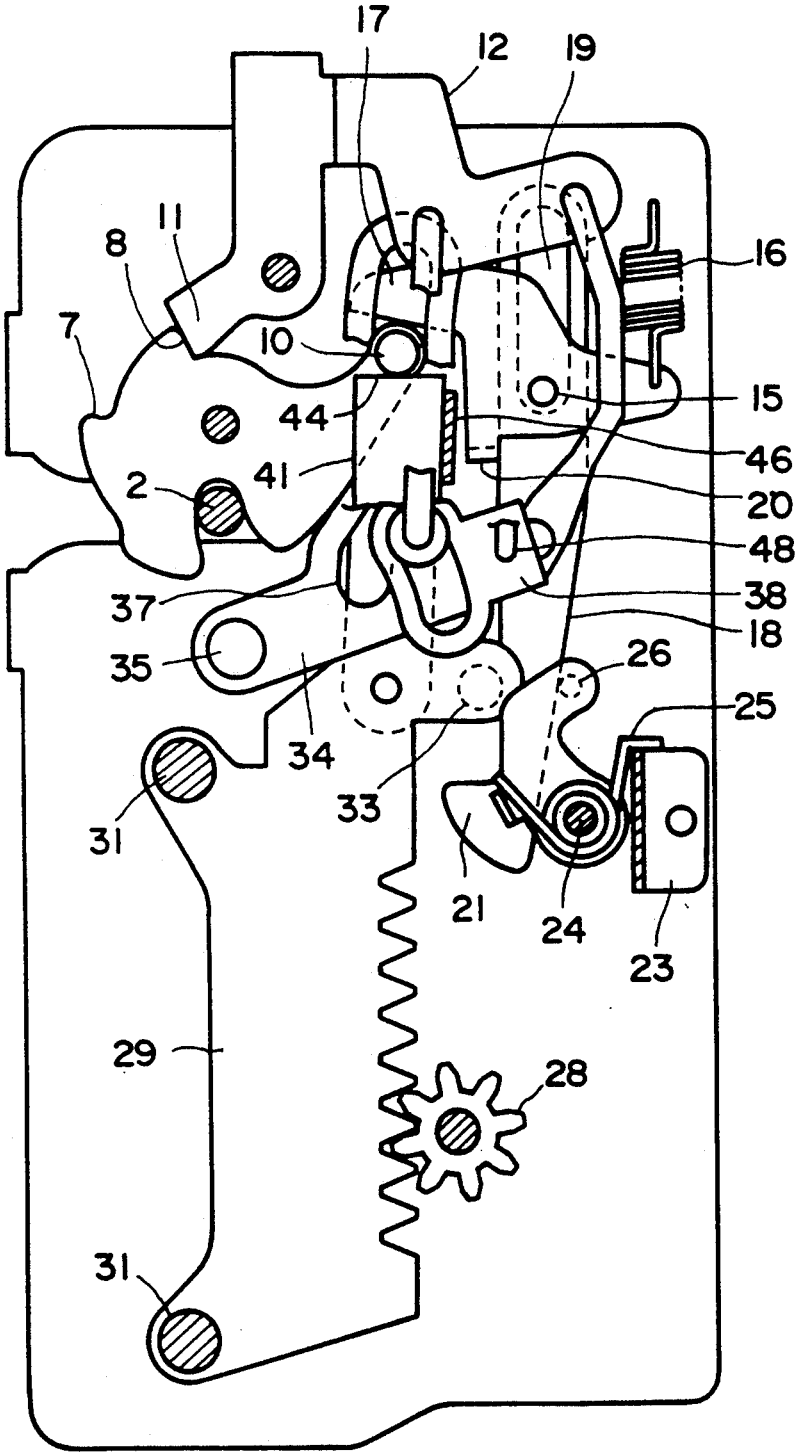
FIG. 3 is a partial elevation view of the lock device of the present invention in its lid-closed condition.

Oppositely, when the latch 4 becomes at its close-lid condition as shown in FIG. 3, its end 9 pushes the pressing lever 14 clockwise and correspondingly the engagement portion 20 moves in a clockwise direction. Due to the motion of the engagement portion 20, the electric-driven-condition relief link 18 additionally moves along the clockwise direction due to a resilient force of the spring 25.

A rod 27 connects the ratchet 12 to the electric-driven-condition relief link 18.

Figure 4:
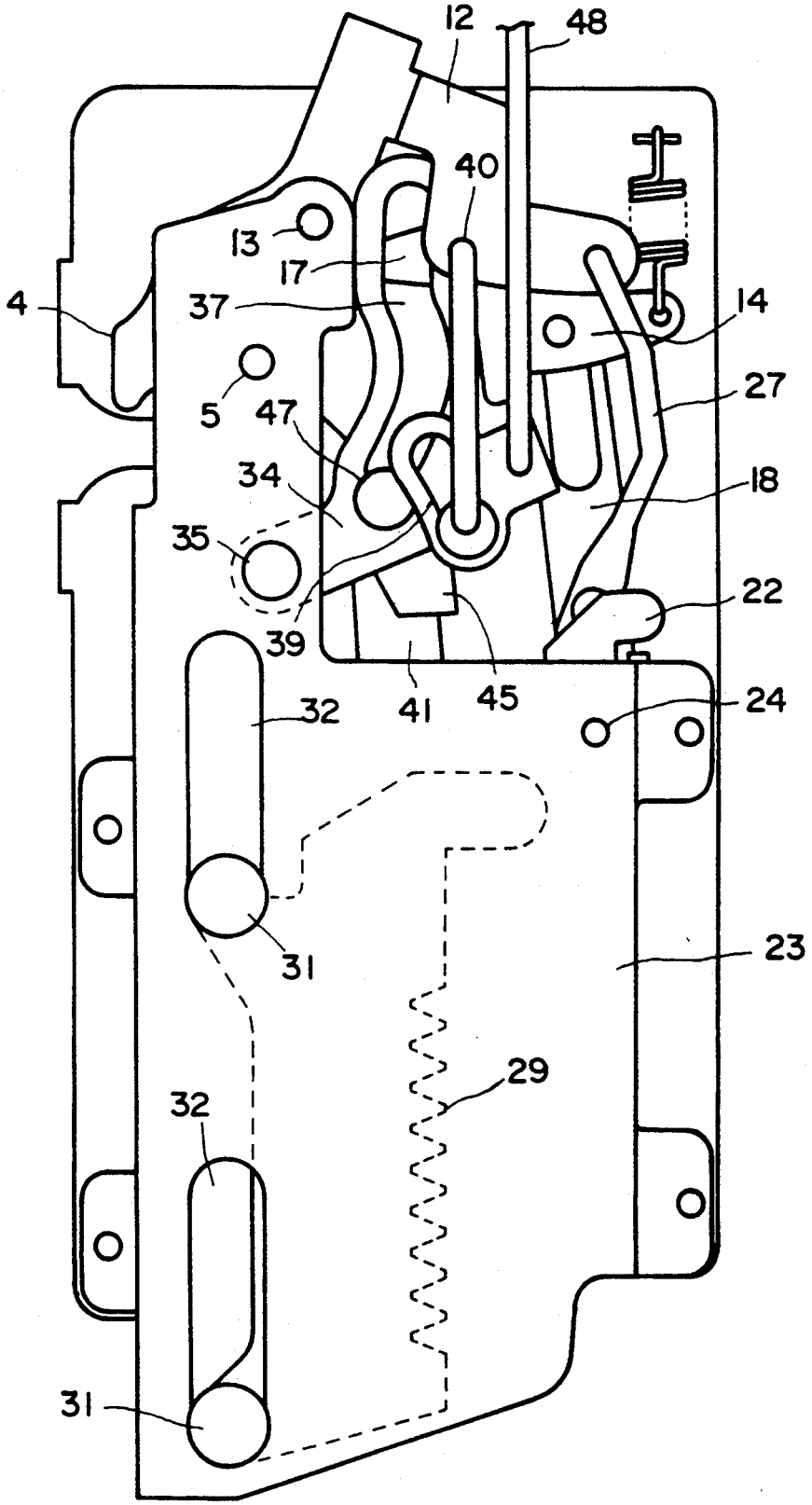
FIG. 4 is an elevation view of the full structure of the motor driven lock device.
Figure 5:
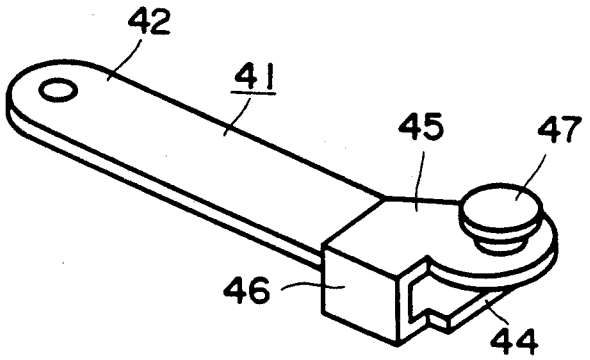
FIG. 5 is a perspective view of a displacing link of the motor driven lock device.

A drive gear 28 is driven by a driving source (not shown), such as a motor. The gear 28 engages with the threads 30 formed on a moving plate 29. As shown in FIG. 4, a pair of sliding pins 31 of the moving plate 29 engage with the guide groove 32 of the cover plate 23 and then the moving plate 29 slides up-and-down by means of a motor or other energy source. An engagement pin 33 enabling to engage with a key portion 21 of the electric-driven-condition relief link 18 is planted at an upper side portion of the moving plate 29. When it is at an open-lid condition of the motor driven lock device, the key portion 21 doesn't engage with the engagement pin 33. On the contrary, when portion 1 moves into a close-lid condition as shown in FIG. 1, the link 18 oscillates in a direction clockwise and the key portion 21 enters into a travel route or track of the engagement pin 33. Consequently, in a condition shown in FIG. 3, when the moving plate 29 lowers, the engagement pin 33 engages with the key portion 21 so as to lower the link 18 and make the ratchet 12 rotate clockwise through the rod 27, lifting the claw portion 11 from the latch 4.

Figure 2:
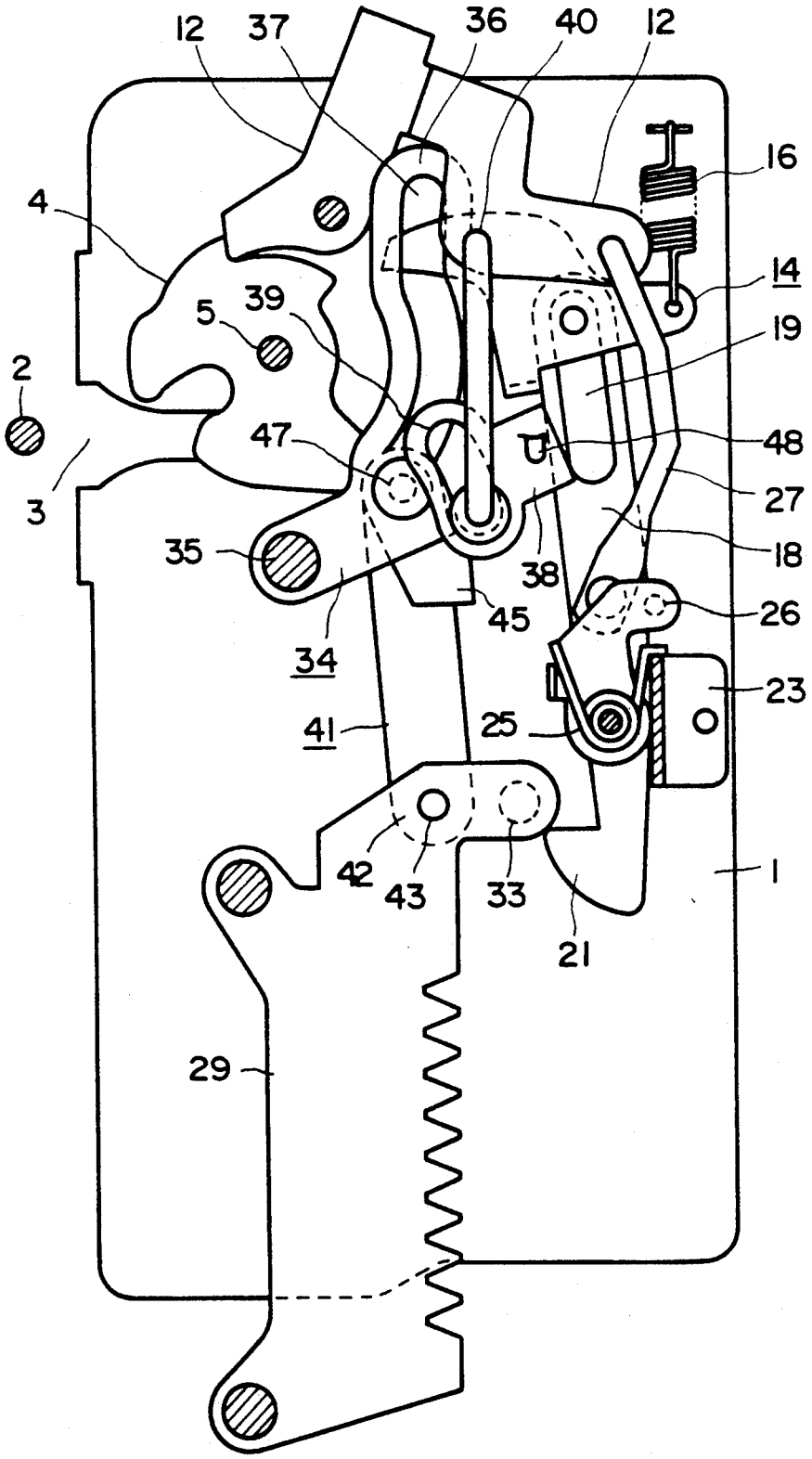
FIG. 2 is a partial elevation view of the open lock device in another condition.
Figure 6:
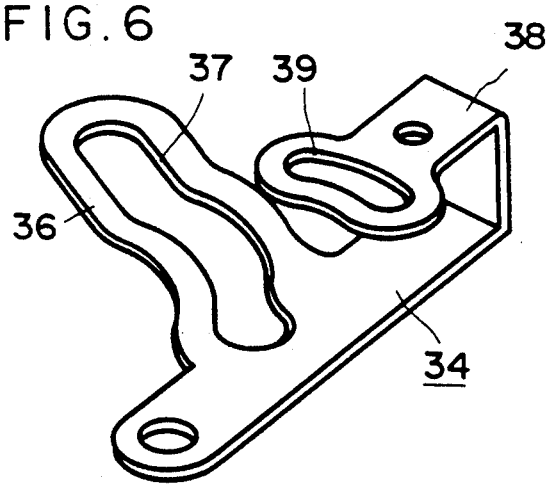
FIG. 6 is a perspective view of a manual release lever of the lock device.
Figure 7:
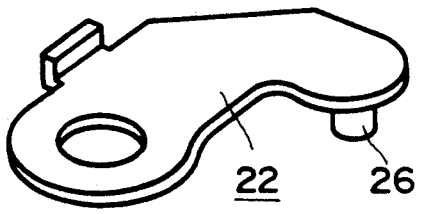
FIG. 7 is a perspective view of a rotary lever of the motor driven lock device of the present invention.

As shown in FIGS. 2–4, a manual relief lever 34 is journalled at about a mid position of the moving plate 29 and the latch 4 by a shaft 35. The manual relief lever 34 is urged counterclockwise due to a resilient force of a spring (not shown) and stalls in a condition contacting with the cover plate 23. The manual relief lever 34 has a tongue-like portions 36 provided with an arc-like long opening 37 around shaft 5. The long opening 37 generally overlaps with a rotation track of the engagement protrusion 10. The manual relief lever 34 has a bent end portion as shown in FIG. 6 of a shape of U-section and an upper part 38 of the bent end portion has an arc-like opening 39 extending around the shaft 35. One end of the rod 40 engages with the arc-like opening 39 and another end of the rod engages with the ratchet 12.

A lower end 42 of the pressing link 41 is journalled with an upper end of the moving plate 29 through a shaft 42. An upper end 44 of the pressing link 41 is formed in a flat surface enabling to engage with the engagement protrusion 10 of the latch 4. The pressing link 41 has a face 45 placed in parallel with the face of the latch 4 and connected to the link 41 through a wall 46 connecting the face 45 to the link 41 at a right angle. A guide pin 47 is planted on the parallel face 45, which pin 47 being loosely fitted into the long hole 37. As a result, when the moving plate 29 moves upward, the pressing link 41 is guided along the long hole 37 and rises, the upper end 44 of the pressing link 41 engages with the engagement protrusion 10, and the latch 4 rotates to its close-lid position.

A rod 48 shown in FIG. 4 is connected to the upper member 38 through its end and to a manual relief handle through its other end.

The drive force for vertically moving the moving plate 29 is controlled by a sensor and a switch, respectively installed at a necessary position. For example, when the striker 2 enters into or advances through the guide groove 3 to the predetermined position, the motor rotates along one direction elevating the moving plate 29. When the switch installed in the driver's seat is turned on, the motor rotates in the reverse direction and the moving plate 29 lowers.

Operation of the electric driven lock device having the mechanism and construction mentioned above according to the present invention will be explained with reference to the accompanying drawings.

When various parts of the mechanism are in an open-door condition of the lock device as shown in FIG. 1 and the trunk lid of a car is manually pushed down or closed, the striker 2 secured to the trunk lid enters into the guide groove 3 formed in the base plate 1 reaching a position in which the striker 2 comes in contact with a U-shaped groove or notch 6 of the latch 4. Then, the sensor (not shown) detects the striker 2 and the motor rotates in a right direction, and the moving plate 29 rises through a gear 28, the pressing link 41 rises too and is guided by the long hole 37. At last, the upper end 44 of the pressing link 41 engages with the engagement protrusion 10 of the latch 4 so as to rotate the latch 4 in its close-lid direction. Consequently, the striker 2 placed in front of or facing the U-shaped groove 6 of the latch 4 is gripped by the U-shaped groove 6 and then is pulled forcibly into the U-shaped groove 6 toward the right.

When the latch 4 has rotated to the close-lid position as shown in FIG. 3, the claw portion 11 of the ratchet 12 engages with the close-lid position engagement stepped portion 8 in order to prevent the latch 4 from reverse-turning. Then, the ratchet 12 makes the electric-driven-condition relief link 18 rise through the rod 27. Simultaneously, the end portion 9 of the latch 4 pushes the leg portion 17 of the pressing lever 14 so as to rotate the lever 14 clockwise by a predetermined angle and to move the engagement member 20 in a clockwise direction. As a result, the electric-driven-condition relief link 18 is relieved from a resilient force of the spring 16 and pressed by the protrusion 26 of the rotary lever 22 when the lever 22 rotates counterclockwise due to function of the spring 25. Thus, the electric-driven-condition relief link 18 moves in a clockwise direction moving the trunk lid to its close-lid condition.

In order to open the trunk lid, the switch at the driver's seat is turned on to rotate the motor in a reverse direction, and the moving plate 29 and the pressing link 41 descend. As shown in FIG. 3, the key portion 21 of the electric-driven-condition relief link 18 is in a travel track of the engagement pin 33 of the moving plate 29 so that key portion 21 engages with the engagement pin 33 and lower the relief link 18 as plate 29 moves down. Consequently, the ratchet 12 rotates clockwise by the rod 27 and the claw portion 11 is lifted from the close-lid-position engagement stepped portion 8 of the latch 4, and the latch 4 rotates owing to a spring (not shown) in a lid opening direction. As a result, the striker 2 is lifted from the latch 4 and the trunk lid opens.

Next, a manual method for opening the trunk lid of the car will be explained.

When the mechanism of the trunk lid is positioned as shown in FIG. 1 and the trunk lid is pushed down by hand of the operator, the striker 2 is placed in a position in which the striker 2 can contact with the U-shaped groove 6 of the latch 4. At this time, if the electric system fails to energize the motor, it is possible by a strong pushing down of the trunk lid by hand to make the latch 4 rotate to its close-lid position with the striker 2 being engaged with the U-shaped groove 6 of the latch 4, thereby the claw portion 11 of the ratchet 12 engages with the close-lid-position engagement stepped portion 8 of the latch 4 closing the trunk lid.

When you want to open by hand the trunk lid, the manual relief handle is operated to turn the manual relief lever 34 clockwise through the rod 48. When the manual relief lever 34 rotates, the rod 40 engaged with the arc-like opening 39 makes the ratchet 12 clockwise and the claw portion 11 is lifted from the close-lid-position engagement stepped portion 8, the pressing link 41 provided with the long opening 37, with which the guide pin 47 engages, rotates clockwise around the shaft 43, the upper end 44 of the pressing link 41 is lifted from the engagement protrusion 10 of the latch 4 moving the latch free and the trunk lid open.

As described above, when the manual relief handle connected to the rod 48 of the lock device according to the present invention, the pressing link 41 preventing the latch 4 from rotating in its relief direction is forcibly removed, so the trunk lid can be firmly opened even if the motor is broken and stops at any position.

In addition, according to the mechanism of the present invention, the electric-driven-condition relief link 18 having the key portion 21 is journalled with the ratchet 12 and the key portion 21 engages with the engagement pin 33, so that it is easy to set the timing of engagement and relief of various parts of the lock device providing a motor driven type lock device for the trunk lid of a car and the like, which device is excellent in its universality.

It is apparently possible to construct the mechanism so as to journal the motor-driven-condition relief link 18 with a side of the motor and to engage the key portion 21 with the ratchet 12. However, altering the mechanism as mentioned above makes the set of the timing of engagement and relief of various parts difficult. It is necessary to newly design the timing set of the various parts even though the lock device of the present invention is a little improved or redesigned.

What is claimed is:

1. An electric driven lock device comprising:

a spring-returned latch rotatably mounted on a base and having a U-shaped groove for engaging a striker of said lock device, a spring-returned ratchet rotatably mounted on said base and engaged to said latch after said latch rotates to a closed-lid position thereby preventing said latch from rotating to an open-lid position, a pressing link slidably engaged to said latch for rotating said latch to said closed-lid position from an open-lid position, a relief link rotatably engaged to said ratchet for lifting said ratchet and permitting said latch to rotate to said open-lid position, motor driven actuator means for slidably engaging said pressing link when moving in a first direction and slidably engaging said relief link when moving in a second direction, said motor driven actuator means moving said pressing link to rotate said latch into said closed-lid position when moving in said first direction and rotating said relief link to permit said latch to rotate to said open-lid position when moving in said second direction, a manual relief lever connected to said pressing link and to said ratchet to permit manual operation, wherein, said manual relief lever produces said open-lid position by moving said pressing link from slidable engagement with said latch and lifting said ratchet from engagement with said latch.

2. The electric driven lock device according to claim 1, wherein said manual relief lever has an arc-like groove formed around a rotation shaft of said latch and a protrusion formed on said pressing link engages with said arc-like groove.

3. The electric driven lock device according to claim 1, wherein said relief link has a key portion at a first end so as to engage with said actuator means and a middle portion of said relief link rotatably engaged by a rod to said ratchet.

4. The electric driven lock device according to claim 3, wherein said relief link is adapted to be displaced by rotation of said latch so as to be disengaged from said actuator means when said latch is in said open-lid position and said relief link engages with said actuator means when said latch is in said closed-lid position.

5. A lock device provided with a striker secured to a trunk lid and a lock housing attached to a car body, said lock device comprising:

a latch means provided on the lock housing so as to rotate, a ratchet engaged to said latch after said latch rotates to a close-lid position so as to prevent said latch from rotation to an open-lid position of said latch, a first switch adapted to turn on when said striker reaches a position in which position the striker comes into contact with the latch, a second switch installed by the driver's seat so as to be manual-operated, motor driven actuator means moving in a first direction when said first switch means turns on and in a second direction when said second switch means turns on, a pressing link connected to said actuator means so as to contact with said latch located in an open-lid position when said actuator means moves in said first direction and consequently turning said latch to a close-lid position, and a relief link adapted to engage with said actuator means when said actuator means moves in said second direction in order to make said ratchet leave said latch, wherein a manual relief lever permitting manual operation has an arc-like groove formed around a rotary shaft of said latch so as to guide a motion of said pressing link due to said actuator means, said ratchet is connected to said manual relief lever, wherein, when said manual relief lever is operated to open said trunk lid, said pressing link is lifted from the rotary track of said latch and simultaneously said ratchet is lifted from said latch.

* * * * *